US010550864B1

(12) United States Patent
Collins et al.

(10) Patent No.: US 10,550,864 B1
(45) Date of Patent: Feb. 4, 2020

(54) HYDRAULIC CYLINDER ARRANGEMENT WITH AUTOMATIC AIR BLEEDING AND FLUID FLUSHING FEATURES

(71) Applicant: Innovative Hydraulics, LLC, Wausau, WI (US)

(72) Inventors: Thomas Joseph Collins, Wausau, WI (US); Aaron William Smith, Marathon, WI (US)

(73) Assignee: Innovative Hydraulics, LLC, Wausau, WI (US)

( * ) Notice: Subject to any disclaimer, the term of this patent is extended or adjusted under 35 U.S.C. 154(b) by 57 days.

(21) Appl. No.: 16/044,149

(22) Filed: Jul. 24, 2018

Related U.S. Application Data

(60) Provisional application No. 62/536,292, filed on Jul. 24, 2017.

(51) Int. Cl.

| | |
|---|---|
| ***F15B 15/16*** | (2006.01) |
| ***F15B 21/044*** | (2019.01) |
| *F15B 13/02* | (2006.01) |
| *F15B 13/04* | (2006.01) |
| *F15B 13/00* | (2006.01) |

(52) U.S. Cl.
CPC ..... *F15B 15/16* (2013.01); *F15B 21/044* (2013.01); *F15B 13/024* (2013.01); *F15B 13/027* (2013.01); *F15B 13/028* (2013.01); *F15B 13/029* (2013.01); *F15B 13/0406* (2013.01); *F15B 2013/004* (2013.01); *F15B 2215/30* (2013.01)

(58) Field of Classification Search
CPC ..... F15B 2013/004; F15B 15/16; F15B 21/0427; F15B 21/044
See application file for complete search history.

(56) References Cited

U.S. PATENT DOCUMENTS

| | | | | |
|---|---|---|---|---|
| 2,676,573 | A * | 4/1954 | Abbe | F15B 15/16 91/443 |
| 2,905,280 | A | 9/1959 | Weaver | |
| 3,653,302 | A * | 4/1972 | Notenboom | F15B 15/16 92/53 |
| 3,757,874 | A | 9/1973 | Claxton | |
| 4,232,849 | A | 11/1980 | Kimber et al. | |
| 4,232,850 | A | 11/1980 | Kimber et al. | |
| 4,266,749 | A | 5/1981 | Lundstrom | |
| 4,368,602 | A | 1/1983 | Manten | |
| 4,457,212 | A | 7/1984 | Unger et al. | |
| 4,883,387 | A | 11/1989 | Myers et al. | |
| 5,390,586 | A * | 2/1995 | Jones | F15B 15/16 91/167 R |
| 5,390,739 | A | 2/1995 | Tailby | |
| 5,846,028 | A | 12/1998 | Thory | |
| 6,305,480 | B1 | 10/2001 | Franklin | |
| 8,201,787 | B2 | 6/2012 | Ingram et al. | |
| 8,496,409 | B2 | 7/2013 | Aksel et al. | |

(Continued)

FOREIGN PATENT DOCUMENTS

| | | | |
|---|---|---|---|
| DE | 102010054291 | A1 | 6/2011 |
| WO | 8301810 | A1 | 5/1983 |

*Primary Examiner* — Michael Leslie
(74) *Attorney, Agent, or Firm* — Boardman & Clark LLP

(57) ABSTRACT

A telescopic hydraulic cylinder is disclosed which has automatic air bleeding and fluid flushing features. A method of removing air from a hydraulic cylinder is also disclosed. A hydraulic circuit with for removing air from a hydraulic cylinder is further disclosed.

19 Claims, 8 Drawing Sheets

(56) References Cited

U.S. PATENT DOCUMENTS

| | | | |
|---|---|---|---|
| 8,882,394 | B2 | 11/2014 | Aksel et al. |
| 9,777,754 | B2 | 10/2017 | Larkin |
| 9,883,147 | B1 | 1/2018 | Zaluski |

* cited by examiner

HYDRAULIC CYLINDER ARRANGEMENT WITH AUTOMATIC AIR BLEEDING AND FLUID FLUSHING FEATURES

CROSS-REFERENCE TO RELATED APPLICATIONS

This application claims priority to U.S. Provisional Patent Application, Ser. No. 62/536,292 filed Jul. 24, 2017, entitled HYDRAULIC CYLINDER ARRANGEMENT WITH AUTOMATIC AIR BLEEDING AND FLUID FLUSHING FEATURES, the entire contents of which is hereby incorporated by reference in its entirety herein.

FIELD

The present invention relates to the field of hydraulically actuated cylinders, generally, but not specifically, used for raising oil and gas drilling structures' masts and subframes.

BACKGROUND

A cylinder is a mechanical device that produces linear motion. A hydraulic cylinder is powered by pressurized hydraulic fluid, which typically is supplied to the cylinder from a hydraulic pump, or hydraulic power unit. Hydraulic fluid or oil is generally considered an incompressible fluid, which delivers smooth motion and operating characteristics to the cylinder.

During assembly of the cylinder, or installing the cylinder into the apparatus or machinery it serves, air may be introduced into the cylinder body, or entrained in the cylinder oil. Air is a compressible fluid, and when used in a hydraulic system operating at elevated pressures, the trapped air can cause erratic behavior or undesirable motion, which can have detrimental effects on the machinery, cause unsafe conditions for workers, and cause damage to the components of the hydraulic system. It is desirable for air to be removed from the hydraulic oil before operating the machinery as intended. In single stage cylinders, this is generally accomplished by cycling the cylinder from fully retracted to fully extended positions, flushing any air out of the cylinder via the hydraulic oil, back to the hydraulic power unit, where the air is removed by various hydraulic devices.

Telescopic cylinders, also known as multi-stage cylinders, have a unique design where multiple stages are nested together in a compact design, and when deployed greatly increase the extended length of the cylinder. These telescopic designs have multiple areas within the cylinder that may trap air that is entrained or present within the hydraulic fluid. This trapped air within the cylinder may cause erratic behavior in the cylinder movement or performance, and should be removed from the cylinder as much as possible, in order to allow the cylinder to display smooth, predictable motion.

There exists a number of products and methods to bleed air from hydraulic cylinders. Examples of such products include a Minimess® fittings or test couplings, bleeder screws, bleeder screws with adapters, and pan head screws with face seal. These existing types of air bleed devices and methods of use thereof have positive and negative attributes. On the positive side, these types of air bleed devices and methods:

a. include a number of various designs, sizes, connection types, materials that are available for use;
b. are readily available and inexpensive to purchase;

c. are known to the industry, have a proven history, and are simple to use; and
d. can be installed in multiple locations in the hydraulic cylinder, targeting areas in which air is likely to collect and become trapped.

On the negative side, these types of air bleed devices and methods:

a. oftentimes require manual labor to open and close the valve, sometimes in awkward or dangerous positions, and sometimes require multiple people to complete the air bleed process;
b. may be under high pressure, and when opened, can release pressure in the vicinity of the operator, causing a safety hazard;
c. possibly can allow contaminants into the cylinder or hydraulic system while opening a valve, and thus exposing the hydraulic fluid to the environment and surrounding atmosphere;
d. allow both air and oil to escape, often into a rudimentary collection pail or similar container, which may be difficult to handle—for example, within the cylinder, typically there does not exist a definite separation between the air and oil, but more so a mixture of the two, or sometimes a foamy consistency, and consequently sometimes a substantial amount of air and oil mixture must be bled from the cylinder to ensure removal of all air—these bled fluids must be disposed of in an environmentally safe manner;
e. may cause an environmental hazard if oil is spilled or uncontained/captures; and
f. the air bleeding process may cause the cylinder to move with operators in the area, potentially in hazardous positions or locations.

In a typical hydraulic cylinder with a commercially available bleeder screw installed, air entrapped within the hydraulic oil in the cylinder would naturally rise to the top of the fluid volume. The air bleed valve is strategically placed in a location to remove this air. The air bleed valve is opened manually, releasing the pressurized oil and air mixture. In this case, the operator would need to be ready with some method to capture this released fluid. Moreover, if a large enough volume of air was in the cylinder, the cylinder would need to be actuated to "push" this air out of the cylinder.

Accordingly, a need exists in the art for a device and method to remove air from a hydraulic cylinder of the type described herein that overcomes one or more of the deficiencies with known devices and methods of bleeding air from such cylinder(s).

SUMMARY

The invention described herein solves one or more the problems that are inherent with existing air bleeding hardware and methods for telescopic cylinders, examples of which are described above. The invention described herein allows for hydraulic fluid to be flushed or conveyed through the cylinder body without actuating the cylinder, and, through the action of the flushing hydraulic fluid, allows for trapped air within the cylinder to be removed without opening or removing any existing component of the cylinder. The invention may also be used to flush hydraulic fluid through the cylinder in extreme temperature conditions in order to bring the operating state of the hydraulic circuit to a more normal condition.

Accordingly, a telescopic hydraulic cylinder is disclosed. The telescopic hydraulic cylinder has automatic air bleeding and fluid flushing features.

More specifically, the telescopic hydraulic cylinder has a barrel having an end cover baseplate, one or more telescoping stages provided within the barrel, and having a final telescoping section rod nested therein, each telescoping stage having one or more internal communication holes, and the final telescoping section rod has an air collection pocket. An end cover gland is provided on the telescopic hydraulic cylinder. A nested internal feed tube system is also provided within the telescoping stages comprising one or more internal feed tubes which act as a conduit for retract side hydraulic fluid flow. An external feed tube is provided on the hydraulic cylinder and acts as a conduit for bleed operating mode hydraulic fluid flow. A manifold is joined to the hydraulic cylinder forming a hydraulic circuit having a normal operating mode and a bleed operating mode. The manifold has a single cartridge valve which, in response to a signal, switches between normal operating mode and bleed operating mode.

A method of removing air from a telescopic hydraulic cylinder is also disclosed. The method includes initiating a bleeding process by actuating a single cartridge valve, either manually or by electronic signal so as to switch from a normal operating mode to a bleed operating mode, which actuation causes the valve to move to a position that blocks a hydraulic line connected to an extend side of the cylinder and connects an external feed tube to a flow circuit thereby completing a Bleed Mode hydraulic circuit. The method also includes directing hydraulic fluid into the manifold through the single cartridge valve, through the external feed tube, and into a retract side of the cylinder; subsequently directing hydraulic fluid through each stage of the cylinder through internal communication holes and into an inner diameter of final telescoping section rod, through an air collection pocket in the rod; and subsequently directing hydraulic fluid through one or more internal feed tubes to the manifold and back to a return line, carrying any air that was present in the air collection pocket out of the hydraulic cylinder with the hydraulic fluid.

A hydraulic circuit for removing air from a hydraulic cylinder is also disclosed. The hydraulic circuit includes a pilot line or inlet connected to a hydraulic fluid supply and fluidly joined to a manifold for transmitting hydraulic fluid. A pilot valve on the pilot line which directs pilot line pressure to a directional valve, the pilot line pressure shifting the directional valve to a position that blocks a hydraulic line connected to an extend side of the hydraulic cylinder and connecting an external feed tube fluidly coupled to a retract side of the hydraulic cylinder. One or more cylinder stages are also provided, each stage having internal communication holes in fluid communication and in fluid communication with an inner diameter of a rod having an air collection pocket. One or more internal feed tubes are provided in fluid communication with the air collection pocket and fluidly coupled to the manifold and a return line to a hydraulic fluid reservoir.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
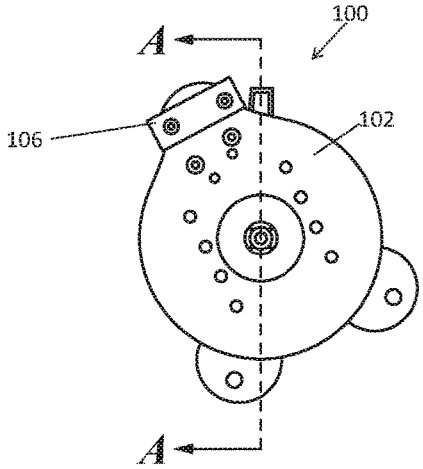
FIG. 1 is an end view of a hydraulic cylinder, according to one or more examples of embodiments of the invention described herein.
Figure 2:
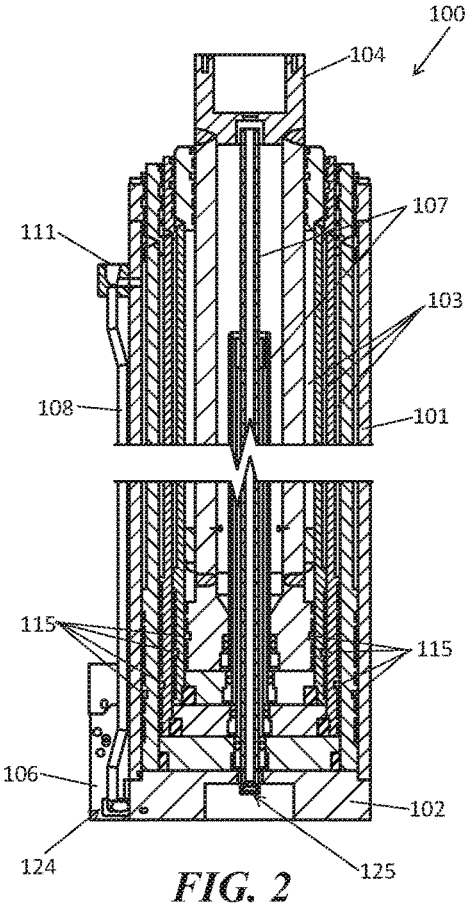
FIG. 2 is a side view, full section cutaway of the hydraulic cylinder taken from Section A-A of FIG. 1.
Figure 3:
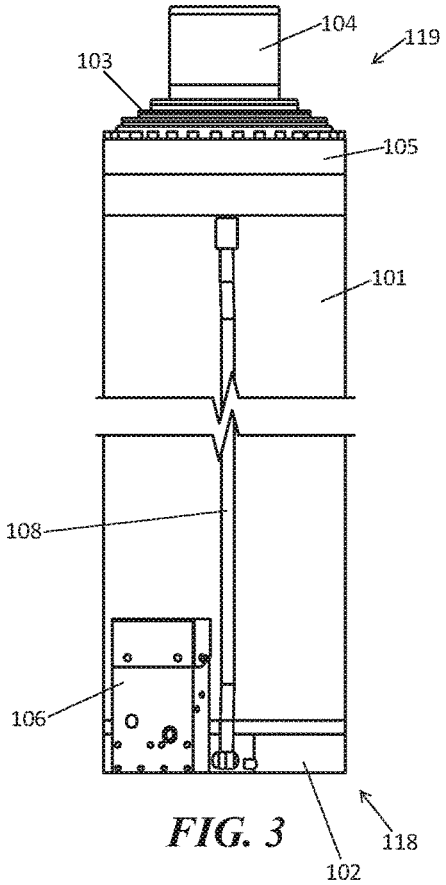
FIG. 3 is a projected side elevation view of the hydraulic cylinder.
Figure 4:
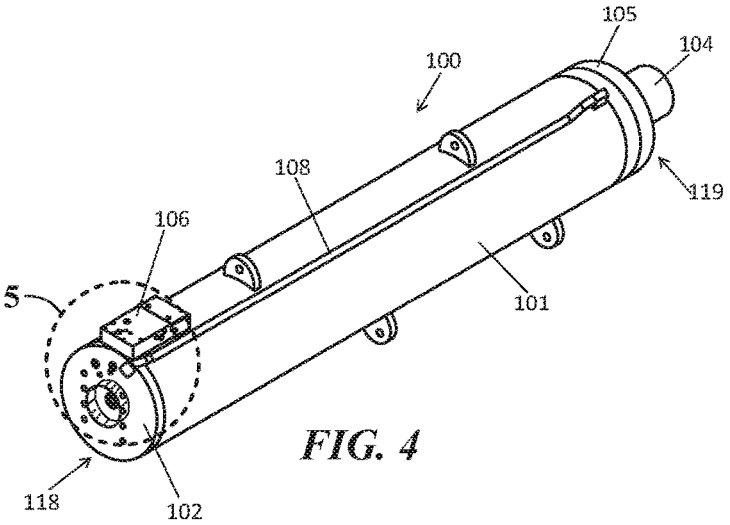
FIG. 4 is an isometric view of the hydraulic cylinder, including a portion of the baseplate shown in transparent form.

It should be understood that the drawings are not necessarily to scale. In certain instances, details that are not necessary to the understanding of the invention or render other details difficult to perceive may have been omitted. For ease of understanding and simplicity, common numbering of elements within the numerous illustrations is utilized when the element is the same in different Figures. It should be understood, of course, that the invention is not necessarily limited to the particular embodiments illustrated herein.

DETAILED DESCRIPTION

Referring to the Figures, generally, a telescopic hydraulic cylinder 100 is shown which includes an outer shell, referred to as a barrel 101, an end cover baseplate 102, telescoping sections or stages 103, final telescoping section rod 104, and end cover gland 105. In one or more preferred examples of embodiments, also contained in the cylinder 100 are one or more of the following: a component containing cartridge valve(s), referred to as manifold 106; internal nested feed tubes—which may be used for conveying retract fluid—referred to as internal feed tubes 107; and a fluid conveyance tube—which may be on the outside of the barrel 101—referred to as external feed tube 108. It is noted that some components are shown in the Figures that are common to, but not requirements of telescopic hydraulic cylinders 100 in themselves. These elements may be optional components of the present invention. These include, for example, counter-balance valves 109 and/or relief valves 110.

The hydraulic cylinder 100 is powered by pressurized hydraulic fluid, which may be supplied to the cylinder 100 from a hydraulic pump or hydraulic power unit which is coupled to the hydraulic cylinder for conveying hydraulic fluid. Such systems are well known in the art and are therefore not illustrated herein. Any suitable pump or power unit capable of delivering the necessary pressure may be acceptable for the purposes provided. Likewise, hydraulic fluid may be retained in the system in one or more hydraulic fluid reservoirs which is/are fluidly coupled to the cylinder 100 through a feed port "P" which is provided to deliver pressurized hydraulic fluid or oil to the hydraulic cylinder 100 and through a return port "T" which is provided for delivery or return of hydraulic fluid to the reservoir. Hydraulic fluid reservoirs are well known in the art and any suitable reservoir may be used which accomplishes the purposes provided.

In addition to the above, one or more components may be provided in one or more preferred examples of embodiments of the cylinder 100 described herein which may be useful for operation of the cylinder 100. For example, these components may include one or more of a check valve 111, shuttle valve 112, pilot valve 113, and/or directional valve 114. While specific examples are provided herein, one of skill in the art would appreciate the variations thereon may be made without departing from the overall scope of the present invention.

The telescopic hydraulic cylinder 100 described herein has various components and hydraulic circuitry for the cylinder to function in the manner as described herein below. Generally, the hydraulic cylinder 100 is designed with a nested internal feed tube system 107, which acts as a conduit for retract side fluid to flow from the base-end mounted manifold 106 to the retract side fluid volume. The cylinder 100 is also designed with an external feed tube 108, which acts as a conduit for a "Bleed Mode" hydraulic oil flow (described in further detail below). The cylinder 100 has a unique combination of a hydraulic circuit containing a manifold 106, cartridge valve(s), and feed tubes 107, 108 that allow the cylinder to function as described herein. One or more controls, which may be manual or electronic, may be provided which permit the hydraulic circuit to be switched between "Normal Mode" and "Bleed Mode."

Referring more specifically to FIGS. 1-4, a telescopic hydraulic cylinder 100 is shown. The cylinder is composed of a barrel 101 which has on its first end 118 a baseplate 102 and an end cover gland 105 on the second end 119 of the barrel 101. One or more stages 103 or telescoping sections, including a final telescoping section rod 104, are received within the barrel 101 and extendable/retractable from the second end 119 of the barrel 101 (see FIGS. 10-13). The barrel 101 and telescoping stages 103, 104 may be of any suitable length, and number, for the intended purposes of the hydraulic cylinder 100.

As illustrated, a manifold 106 may also be attached to the barrel 101. One or more external feed tubes 108 may also be attached to the barrel 101. However, it is contemplated that the manifold 106 and/or external feed tubes 108 may not be attached to the barrel 101. Likewise, feed tube 108 is referred to as "external" but one of skill in the art will appreciate that it may be contained within a structure or within at least a portion of a hydraulic cylinder.

Figure 5:
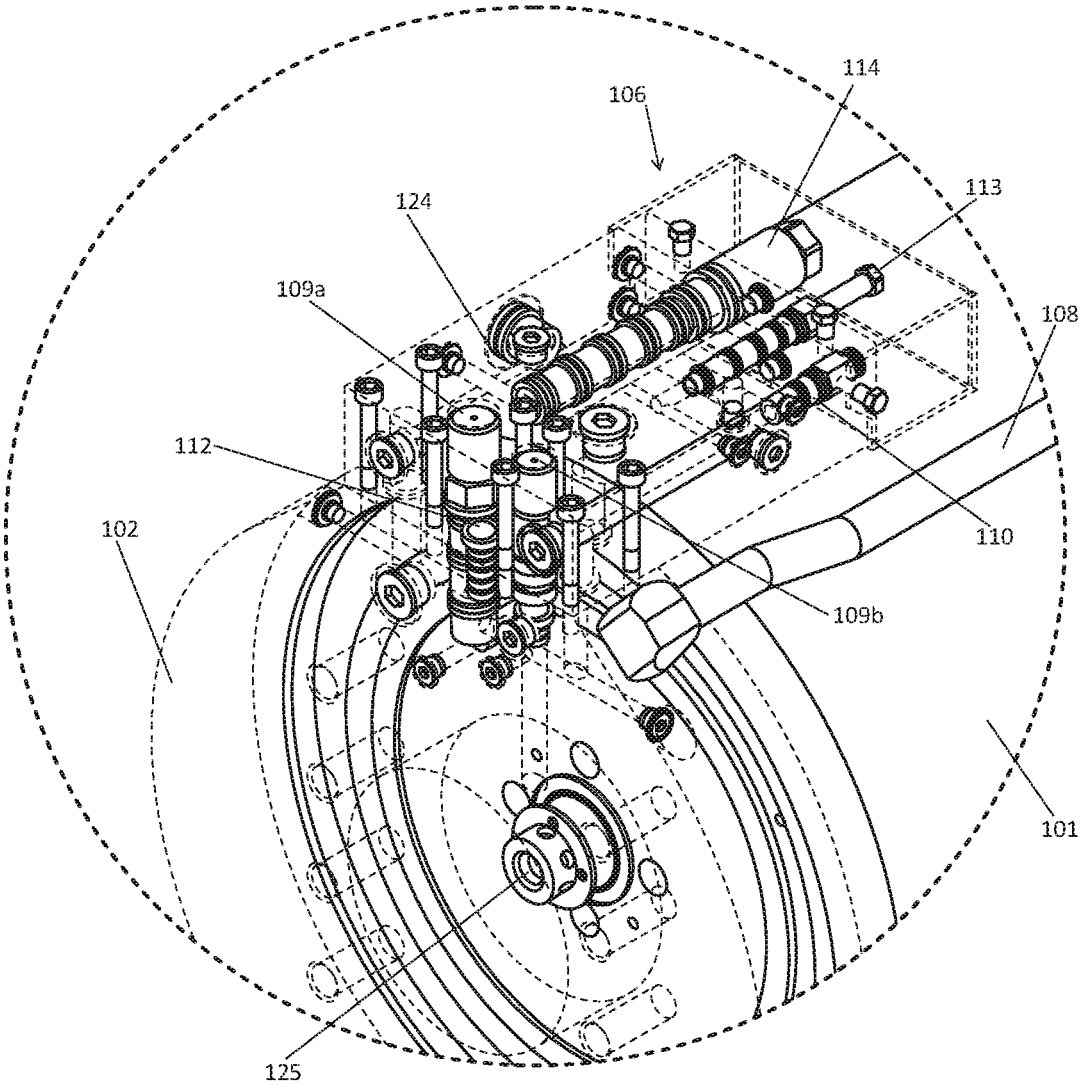
FIG. 5 is an isometric cropped view of the baseplate and manifold which are attached to the cylinder, as shown in FIG. 4, a portion of the manifold and baseplate being shown as transparent.

The manifold 106 is more specifically illustrated in FIG. 5. In the illustrated embodiment the manifold 106 is attached to the barrel 101 near the first end 118 and baseplate 102. The manifold 106 includes counter balance valves 109*a*, 109*b*, relief valve 110, shuttle valve 112, pilot valve 113, and directional valve 114. In this regard, the manifold 106 may include one or more cartridge valves. That is, cartridge valves, also known as 2/2-way valves or logic elements, may be used for directional, pressure, check, and flow control. These cartridge valves are a compact design that can be used in hydraulic manifold systems. Advantageously, these valves work well for applications which require high flow rates and leak-free control. The operation of these valves will be more fully described hereinbelow in relation to the modes of operation of the telescopic cylinder 100.

Figure 12:
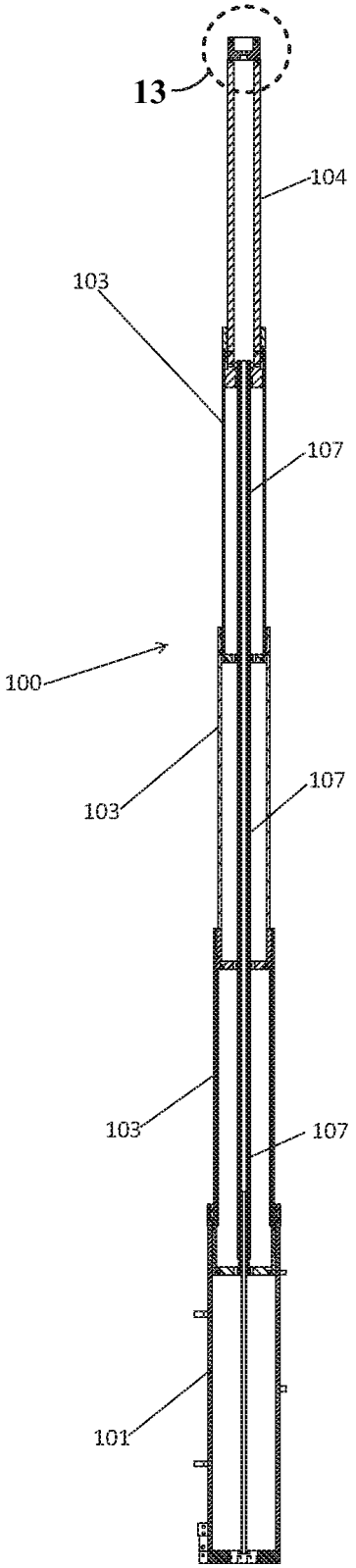
FIG. 12 shows a partial cross section of the hydraulic cylinder in a vertical orientation, rod up, with all stages deployed to full extension, with the external feed tube removed.
Figure 13:
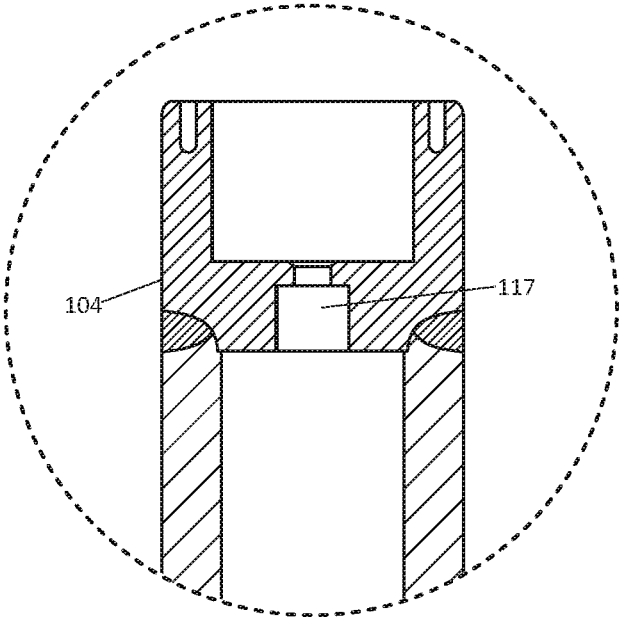
FIG. 13 shows a detail view of the rod end of the hydraulic cylinder in a vertical orientation, rod up, with all stages deployed to full extension.

The cylinder 100 includes a number of stages 103 and a rod 104 which nest within one another, and which stages and rod are extendable/retractable. In the illustrated embodiment shown in FIGS. 10-11, the hydraulic cylinder has the first stage 103 nearly deployed to full extension, with the latter stages and rod 104 still retracted against the next stage. Each stage 103 has one or more internal communication holes 115 that allow for hydraulic fluid flow. FIG. 12 illustrates the hydraulic cylinder 100 fully extended, with each stage 103 visible and the rod 104 at the top. Referring to FIG. 13, the rod 104 has an air collection pocket 117.

The telescopic hydraulic cylinder and hydraulic circuit described herein and their various components may be manufactured using methods and materials that are known to those skilled in the industry.

Generally, to extend the telescopic hydraulic cylinder, oil or hydraulic fluid is directed to the piston side of the cylinder (e.g., the extend side 124 of the cylinder 100), causing the cylinder 100 to extend. Additionally, oil or hydraulic fluid from the rod 104 side or retract side 125 of the cylinder is passed through a control valve back to the reservoir. If the valve is placed in a neutral position, oil or hydraulic fluid in the cylinder 100 is trapped, holding it in a fixed position. When the valve is shifted in the opposite position (retract), oil or hydraulic fluid is directed to the rod side or retract side 125 of the cylinder 100, causing the cylinder to retract. Oil or hydraulic fluid from the extend side 124 of the cylinder 100 passes through the valve back to the reservoir. More specifically, in a telescopic cylinder 100, retraction may occur by sealing each moving stage's 103 piston area outside diameter with the next larger stage's 103 inside diameters and providing internal hydraulic fluid transfer holes 115 in each moving stage 103. The transfer holes or internal communication holes 115 are located just above the pistons in the body of the stage 103. Oil flows from the retraction port, located in the present embodiment in the rod 104 internal feed tube(s) 107 and into the smallest stage. The internal communication holes 115 allow hydraulic fluid to enter and pressurize the volume between the next stage's internal diameter and the smaller stage's outer diameter. Pressure in this volume generates the force to move or retract the smaller stage into the larger stage 103.

EXAMPLES

The following Examples are an illustration of one or more examples of embodiments of methods for carrying out the invention and are not intended as to limit the scope of the invention.

Example 1

Normal Mode Use

Figure 6:
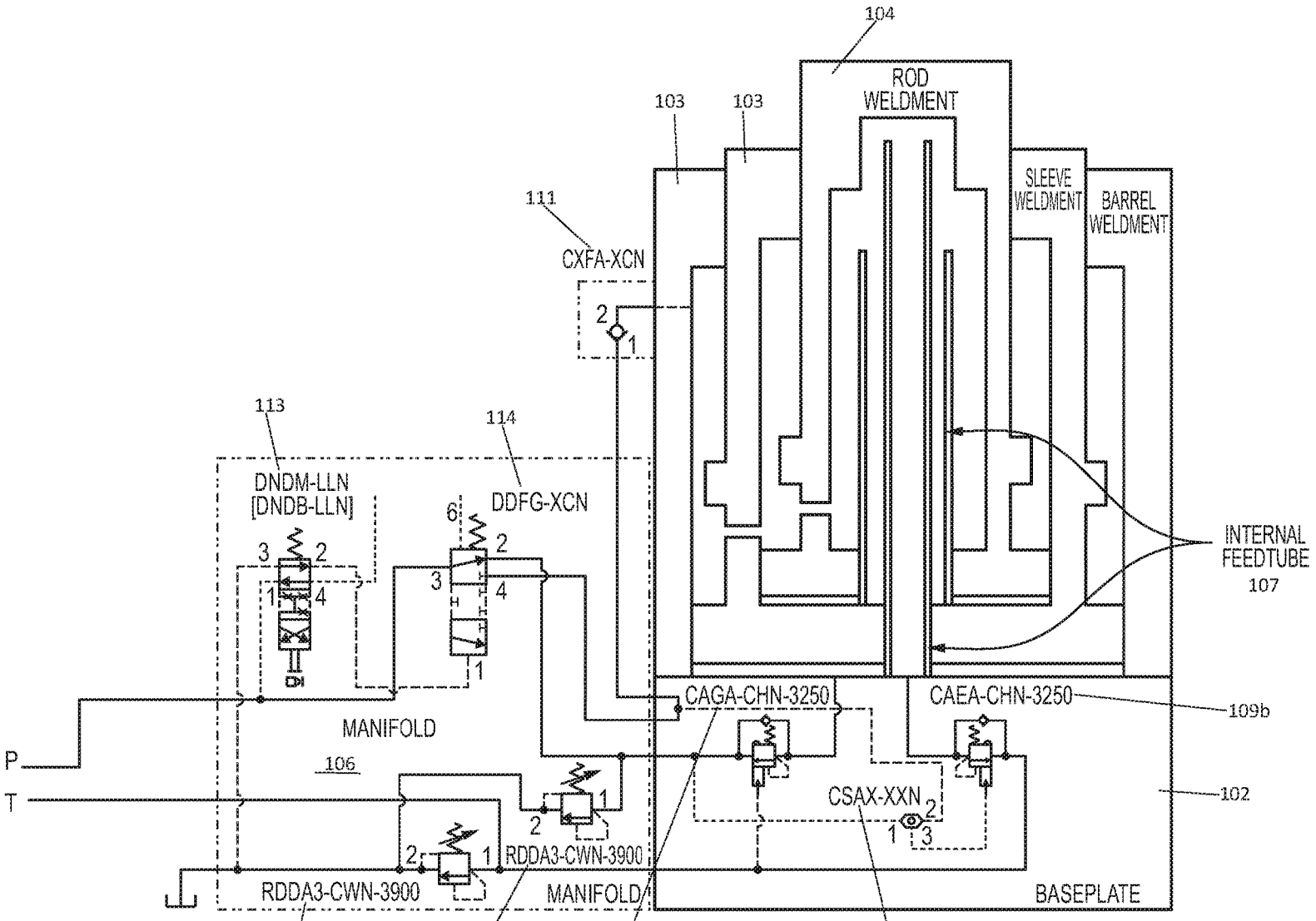
FIG. 6 is a hydraulic schematic depicting a telescopic cylinder rated for 40 gpm (gallons per minute); the circuit is shifted in "Normal Mode," with the cylinder extending.
Figure 7:
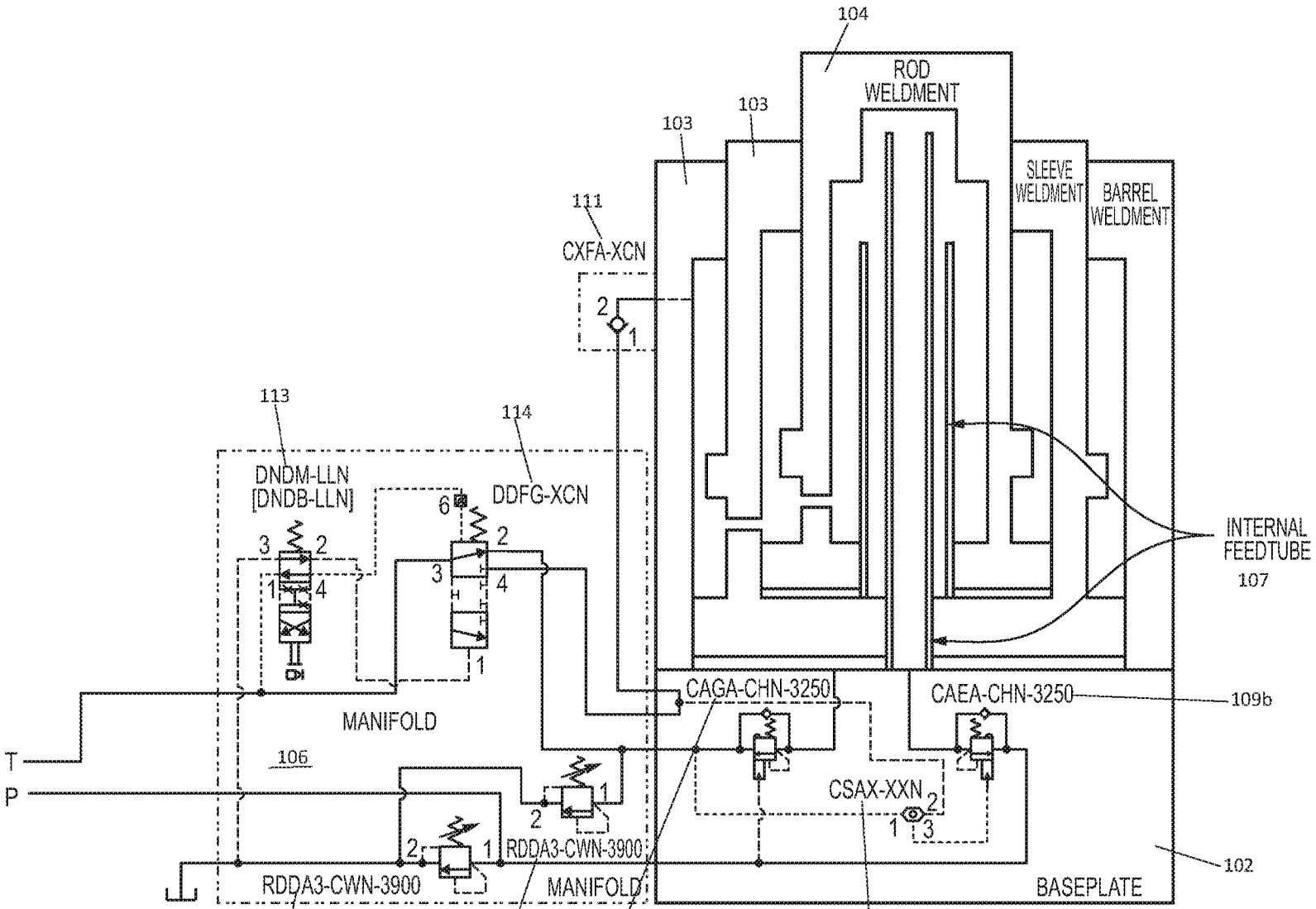
FIG. 7 is a hydraulic schematic depicting a telescopic cylinder rated for 40 gpm; the circuit is shifted in "Normal Mode," with the cylinder retracting.

"Normal Mode" is defined as when the cylinder 100 is used in a manner that the cylinder 100 was designed for, or for the cylinder 100 to complete the working motion or action required of it by the application or apparatus. FIGS. 6-7, show hydraulic circuits shifted between extend and retract, respectively, in view of FIGS. 1-5 and 10-13. A pilot valve 113 is provided. A suitable pilot valve 113 may be a 4-way, manually operated, directional spool valve (available from Sun Hydraulics Corporation, as DNDM-LLN). The pilot valve 113 is provided in an unenergized state, connecting the pressurized fluid pilot line "P" to a directional valve 114. A suitable directional valve 114 may be a 3-way, 2-position, pilot-to-shift, directional valve (available from Sun Hydraulics Corporation, as DDFG-XCN). The directional valve 114 directs the extend side flow to the extend side 124 of the cylinder 100.

Referring to FIG. 6, when pressure and flow is applied to the cylinder 100 from the hydraulic power unit to extend the cylinder 100, this pressurized flow is directed into the manifold 106, through the directional valve 114, into the baseplate 102, through a counterbalance valve 109*a*. A suitable counterbalance valve 109*a* is a 3:1 pilot ratio, vented counterbalance valve, atmospherically referenced (available from Sun Hydraulics Corporation, as CAGA-CHN). The pressurized flow is directed through the counterbalance valve 109 and into the extend side 124 of the cylinder 100, which extends the stages 103 and rod 104 until the cylinder 100 reaches full extension, or the power source is shut off. During extension of the cylinder 100, the retract side fluid is directed through the internal feed tubes 107, to the baseplate 102, through counterbalance valve 109*b* (a suitable counterbalance valve is available from Sun Hydraulics Corporation, as CAEA-CHN), to the manifold 106, and back to the return line "T" to the hydraulic fluid reservoir.

Referring to FIG. 7, when pressure and flow is applied to the cylinder 100 from the hydraulic power unit to retract the cylinder 100, this pressurized flow is directed into the manifold 106, into the baseplate 102, through the counterbalance valve 109*b*, through the internal feed tubes 107, and into the retract side 125 of the cylinder 100, which retracts the stages 103 and rod 104 until the cylinder 100 reaches full retraction, or the power source is shut off. During retraction, the extend side fluid is directed through the baseplate 102, through the counterbalance valve 109*a*, to the manifold 106, through the directional valve 114, and back to the return line "T" to the hydraulic fluid reservoir.

Example 2

Bleed Mode Use

"Bleed Mode" is defined as when the cylinder 100 is used in a manner to flush fresh oil through the cylinder 100, carrying out trapped air, oil with entrained air, and/or cold oil, should the cylinder 100 need to be "warmed up" in a cold temperature environment. In various examples of embodiments, the telescopic hydraulic cylinder 100 does not produce linear motion in Bleed Mode, as it is hydraulically locked in the fully retracted position.

Prior to switching to Bleed Mode, any air in the cylinder 100 may be forced into the uppermost portion 117 of the rod 104 inner diameter (see FIGS. 12-13). First, by using some external means, which in some examples of embodiments may be another smaller cylinder, the hydraulic cylinder 100 may be moved to be positioned in a vertical orientation with the rod end 104 up. The cylinder 100 may then be fully extended and fully retracted one complete cycle. As the cylinder 100 is extended, oil and air is pushed from the larger stage 103 to the next smaller stage 103 through internal communication holes 115. As each stage 103 is extended and reaches full extension, any trapped air is moved to the next smaller stage 103, until it finally is pushed into the rod stage 104, where it collects in the uppermost area of the rod inside diameter in the air collection pocket 117. The cylinder 100 is then fully retracted, still in the vertical orientation. The smallest diameter internal feed tube 107 is now protruding into the air collection pocket 117 in this position.

Figure 8:
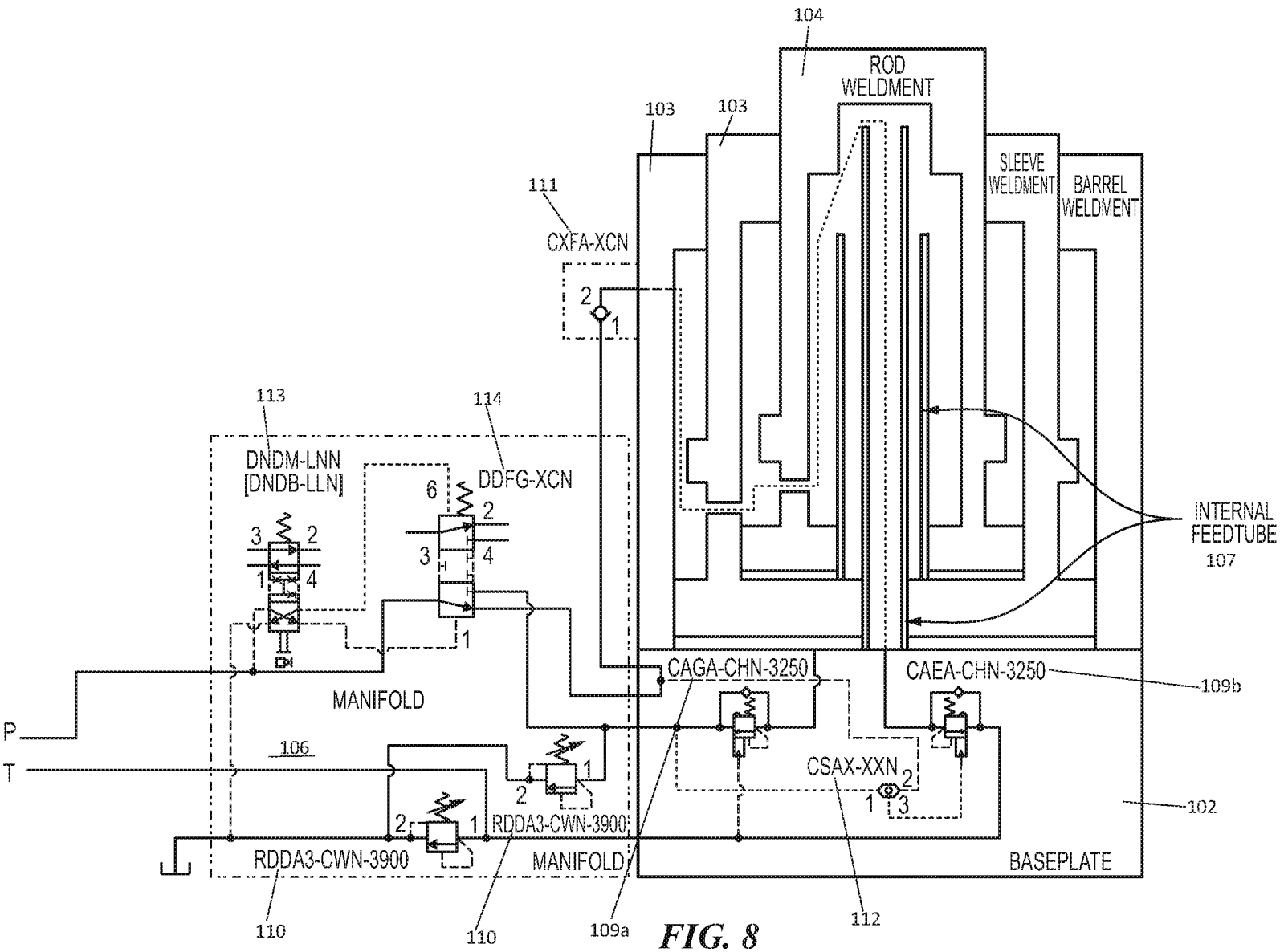
FIG. 8 is a hydraulic schematic depicting a telescopic cylinder rated for 40 gpm; the circuit is shifted in "Bleed Mode."
Figure 9:
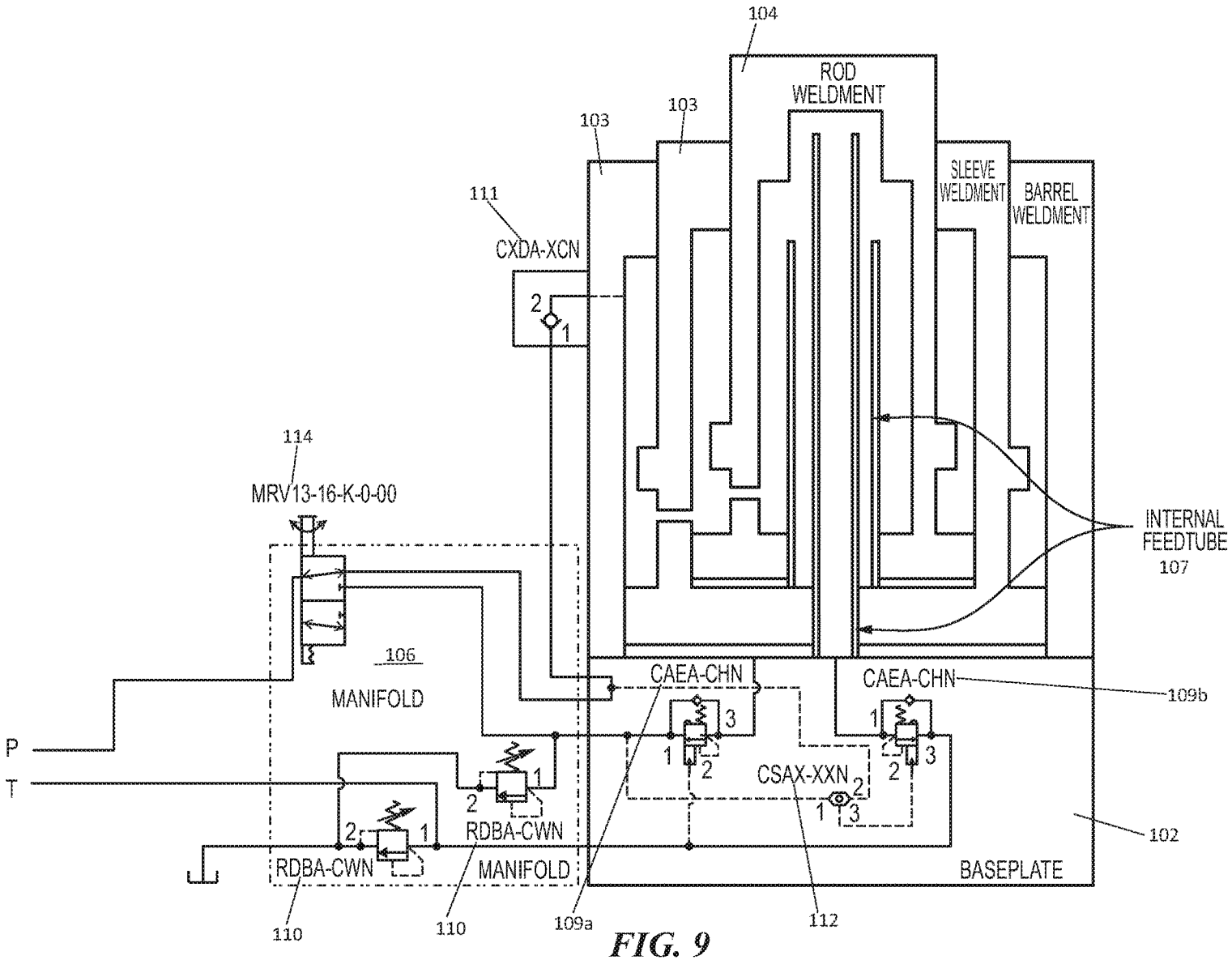
FIG. 9 is an alternate hydraulic schematic depicting a telescopic cylinder rated for 17 gpm; the circuit is shifted in "Bleed Mode."
Figure 10:
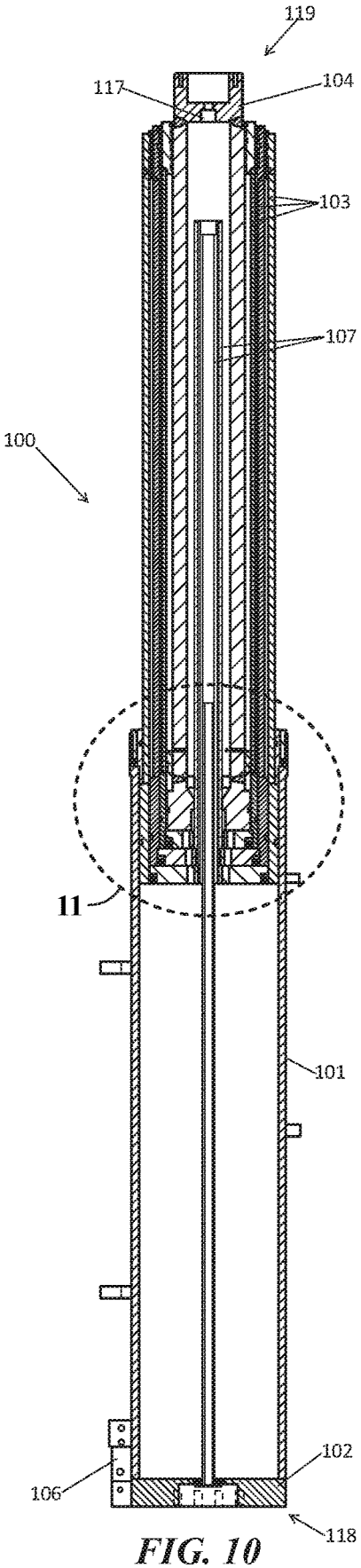
FIG. 10 shows a partial cross-section of the hydraulic cylinder in a vertical orientation, rod up, with the first stage nearly deployed to full extension; the latter stages and rod are still retracted against the next stage, with the external feed tube removed.
Figure 11:
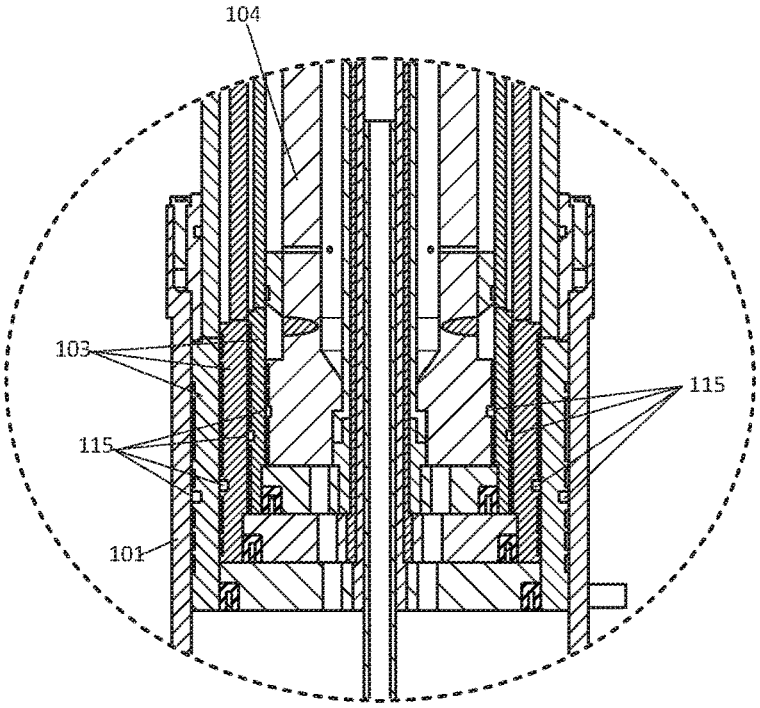
FIG. 11 shows a detailed cross-sectional view of the first stage piston and barrel gland area, the hydraulic cylinder in a vertical orientation, rod up, with the first stage nearly deployed to full extension; the latter stages and rod are still retracted against the next stage.

Referring to FIGS. 8-9, which show hydraulic circuits, in view of FIGS. 1-5 and 10-13, in one example of embodiments, the bleeding process is initiated by actuating a single cartridge valve, either manually or by electronic signal (e.g., a solenoid operated valve). This single valve does not release fluids from the closed hydraulic system, but does alter the hydraulic circuit designed into the cylinder envelope, switching from "Normal" operating mode to "Bleed" operating mode. Advantageously, there are not multiple valves to open, and only a single operator is required to complete the bleeding process.

Referring to FIG. 8, to initiate the air bleed function, the operator energizes the pilot valve 113, which directs the pilot line pressure to the directional valve 114. In FIG. 9, only a directional valve 114, which may be a rotary cartridge valve (available from Eaton Corporation plc, as MRV13-16-K-0-00) is used. The pilot line "P" pressure shifts the directional valve 114 to a position that serves two functions: first, the hydraulic line connected to the extend side 124 of the cylinder 100 is capped or blocked, which prevents the cylinder 100 from moving by not allowing fluid to enter or leave the extend side of the cylinder 100; second, the external feed tube 108 is now connected to the pressure/flow circuit (see FIGS. 8-9), completing the Bleed Mode circuit.

The operator actuates the cylinder control valve 114 as to direct pressure and flow to the extend side 124 of the cylinder 100. However, with the cylinder 100 shifted into Bleed Mode, the pathway of the hydraulic oil is redirected into the manifold 106, through the directional valve 114, into the baseplate 102, through the external feed tube 108, through a check valve 111. A suitable check valve 111 may be a free flow nose to side check valve (available from Sun Hydraulics Corporation, as CXFA-XCN). The hydraulic oil is directed through the check valve 111 and into the retract side 125 of the cylinder 100. The fluid continues to flow through each stage 103 of the cylinder 100 through the internal communication holes 115, into the inner diameter of the rod 104, up through the air collection pocket 117, and is directed through the internal feed tubes 107, to the baseplate 102, through the counterbalance valve 109*b*, to the manifold 106, and back to the return line "T" to the hydraulic fluid reservoir. Thus, any air that was present in the air collection pocket 117 would be carried out with the hydraulic fluid via the Bleed Mode circuit.

After some period of flushing oil through the cylinder 100 in Bleed Mode, the operator may shut off the pressure/flow to the cylinder 100, and de-energize the pilot valve 113, which directs the pilot line pressure to the directional valve 114. The pilot line pressure, and the spring bias, shifts the directional valve 114 back to Normal Mode position. The cylinder 100 can now be extended and retracted as a normal cylinder would be, and the operator may watch for smooth operation, optionally repeating the bleeding procedure until smooth operation is achieved.

As can be seen in FIGS. 6-9, various additional valves may be included in the hydraulic circuit. For example, a shuttle valve 112, such as a single ball shuttle valve (available from Sun Hydraulics Corporation, as CSAX-XXN) that connects the higher of two work ports to the signal or common port may be used. Likewise, one or more pressure relief valves 110 or cartridges are shown in the manifold 106 (suitable examples of which are available from Sun Hydraulics Corporation, as RDDA3-CWN-3900, and from Eaton Corporation plc, as RDBA-CWN).

An example use may consist of the operator positioning the cylinder 100 in a vertical orientation, extending and retracting the cylinder 100 one or more times, then switching to Bleed Mode and flushing hydraulic oil through the cylinder 100 for a period of time. The hydraulic circuit may then be them shifted back to Normal Mode, and the cylinder 100 cycled one or more times to full extend and retract. If the cylinder 100 displays normal movement with no stuttering, jerkiness, etc., the cylinder 100 may be ready for use, as the air has been removed. If the cylinder 100 does not operate smoothly, an operator may repeat flushing of the oil and extending/retracting the cylinder 100 until the motion is smooth.

While specific examples of the invention are described above, variations thereon may also be acceptable for accomplishing the purposes provided. For example, a different combination of cartridge valves could be used to direct flow from Normal to Bleed Modes. Likewise, the internal feed tube system could be replaced by hollow-wall tubular stage sections, used for the conducting hydraulic oil to the retract side of the cylinder. The physical location of the valves could be located differently than those shown in the diagrams. Electronic valves could also be used in place of pilot operated valves. A similar circuitry could be used for a cylinder in the rod down orientation. Various steps may also be performed in different orders, amounts, and periods of time, etc.

Advantageously, the invention described herein may be used to remove entrained or trapped air from telescopic or single-stage cylinders designed for such applications where the duty cycle is low, where there are long waiting periods between cylinder movements, where there are multiple internal locations that might trap air, and/or for a cylinder that is disconnected and reconnected to the hydraulic power source, and the like.

In one example of embodiments, the bleeding process is initiated by actuating a single cartridge valve, either manually or by electronic signal (e.g., a solenoid operated valve). This single valve does not release fluids from the closed hydraulic system, but does alter the hydraulic circuit designed into the cylinder envelope, switching from "Normal" operating mode to "Bleed" operating mode. Advantageously, there are not multiple valves to open, and only a single operator is required to complete the bleeding process.

Advantageously, because no valves are opened to release the pressurized fluid to the environment or atmosphere (outside of the contained hydraulic circuit), it is unlikely and unexpected that any operators could be exposed to released pressurized hydraulic fluid, and related personal safety hazards associated with pressurized fluids. There is minimal possibility of a fluid spill during the bleeding process, and subsequent environmental hazard.

In addition to the foregoing advantages, by switching the hydraulic circuit to Bleed Mode, certain valves in the hydraulic circuit are shifted in such a manner such that the portion of the hydraulic circuit that includes the cylinder extend fluid volume is blocked from the hydraulic circuit. Consequently, fluid is not allowed to enter or leave the extend side of the cylinder, thus hydraulically locking the cylinder in the fully retracted position, minimizing the possibility of the cylinder moving during the bleeding procedure.

The foregoing is a detailed description of one or more illustrative embodiments of the present invention. As these embodiments of the present invention are described with reference to the aforementioned drawings, various adaptations of the methods and or the specific structures described may become apparent to those skilled in the art. All such modifications, adaptations, or variations that rely upon the teaching of the present invention, and through which these teachings have advanced the art, are to be considered within the spirit and the scope of the present invention. For example, the hydraulic circuitry may be organized differently to accomplish the same function as to what is shown. Therefore, these descriptions and drawings are not to be considered in a limiting sense as it is understood that the present invention is in no way limited to the embodiments illustrated.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A telescopic hydraulic cylinder comprising:

a barrel having an end cover baseplate;

one or more telescoping stages provided within the barrel, and having a final telescoping section rod nested therein, each telescoping stage having one or more internal communication holes, and the final telescoping section rod having an air collection pocket;

an end cover gland;

a nested internal feed tube system within the telescoping stages comprising one or more internal feed tubes which act as a conduit for retract side hydraulic fluid flow;

an external feed tube which acts as a conduit for bleed operating mode hydraulic fluid flow; and a manifold joined to the hydraulic cylinder forming a hydraulic circuit having a normal operating mode and the bleed operating mode, the manifold having a single cartridge valve which in response to a signal switches between normal operating mode and bleed operating mode.

2. The telescopic hydraulic cylinder of claim 1, wherein the manifold further comprises one or more of a check valve, a shuttle valve, a pilot valve, and/or a directional valve.

3. The telescopic hydraulic cylinder of claim 1, further comprising a counterbalance valve.

4. The telescopic hydraulic cylinder of claim 1, further comprising a relief valve.

5. The telescopic hydraulic cylinder of claim 1, wherein when the cylinder is in the fully retracted position, one of the nested internal feed tubes protrudes into the air collection pocket.

6. The telescopic hydraulic cylinder of claim 1, wherein when the cylinder is in bleed operating mode, the cylinder is hydraulically locked in a fully retracted position.

7. A method of removing air from a telescopic hydraulic cylinder comprising:

initiating a bleeding process by actuating a single cartridge valve, either manually or by electronic signal so as to switch from a normal operating mode to a bleed operating mode, which actuation causes the valve to move to a position that blocks a hydraulic line connected to an extend side of the cylinder and connects an external feed tube to a flow circuit thereby completing a Bleed Mode circuit;

directing hydraulic fluid into a manifold through the single cartridge valve, through the external feed tube, and into a retract side of the cylinder;

subsequently directing hydraulic fluid through each telescoping stage of the cylinder through internal communication holes and into an inner diameter of final telescoping section rod, through an air collection pocket in the rod; and subsequently directing hydraulic fluid through one or more internal feed tubes to the manifold and to a return line, carrying any air that was present in the air collection pocket out of the cylinder with the hydraulic fluid.

8. The method of claim 7, wherein the cylinder does not produce linear motion in bleed operating mode.

9. The method of claim 8, wherein the cylinder is hydraulically locked in a fully retracted position.

10. The method of claim 7, further comprising the step of prior to initiating the bleeding process, extending and retracting the cylinder to force air into the air collection pocket in the final telescoping section rod.

11. The method of claim 7, further comprising in normal operation mode, directing extend side hydraulic fluid flow to the extend side of the cylinder by directing hydraulic fluid into the manifold through the single cartridge valve into the extend side of the cylinder, and extending one or more of the telescoping stages and rod, and simultaneously conveying return hydraulic fluid from the retract side through the one or more internal feed tubes to the manifold and through the return line.

12. A hydraulic circuit for removing air from a hydraulic cylinder comprising:

a pilot line or inlet connected to a hydraulic fluid supply and fluidly joined to a manifold for transmitting hydraulic fluid;

a pilot valve on the pilot line which directs pilot line pressure to a directional valve, the pilot line pressure shifting the directional valve to a position that blocks a hydraulic line connected to an extend side of the hydraulic cylinder and connecting an external feed tube fluidly coupled to a retract side of the hydraulic cylinder;

one or more cylinder stages, each stage having internal communication holes in fluid communication and in fluid communication with an inner diameter of a rod having an air collection pocket; and one or more internal feed tubes in fluid communication with the air collection pocket and fluidly coupled to the manifold and a return line to a hydraulic fluid reservoir.

13. The hydraulic circuit of claim 12, further comprising a check valve between the external feed tube and the retract side of the hydraulic cylinder.

14. The hydraulic circuit of claim 12, wherein the manifold further comprises one or more pressure relief valves.

15. The hydraulic circuit of claim 12, wherein the manifold or a baseplate further comprises a shuttle valve.

16. The hydraulic circuit of claim 12, wherein the manifold or a baseplate further comprises one or more counterbalance valves.

17. The hydraulic circuit of claim 12, wherein the directional valve is a rotary valve.

18. A hydraulic cylinder having the hydraulic circuit of claim 12.

19. A telescopic hydraulic cylinder having the hydraulic circuit of claim 12.

* * * * *